US006270578B1

(12) United States Patent
Murakoshi

(10) Patent No.: US 6,270,578 B1
(45) Date of Patent: Aug. 7, 2001

(54) TRANSFER HEAD OF A COATING FILM TRANSFER TOOL

(75) Inventor: Yasuo Murakoshi, Ageo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 09/260,484

(22) Filed: Mar. 2, 1999

(30) Foreign Application Priority Data

Sep. 25, 1998 (JP) ..... 10-287358

(51) Int. Cl.[7] ..... B05C 21/00

(52) U.S. Cl. ..... 118/257; 118/200; 156/577; 156/579

(58) Field of Search ..... 118/200, 257; 156/577, 579

(56) References Cited

U.S. PATENT DOCUMENTS 4,671,687 6/1987 Tamai ..... 400/695
4,853,074 8/1989 Manusch et al. ..... 156/577

FOREIGN PATENT DOCUMENTS 0 170 222 2/1986 (EP) .
0 313 719 5/1989 (EP) .
0 427 870 5/1991 (EP) .
0 742 111 11/1996 (EP) .

*Primary Examiner*—Laura Edwards
(74) *Attorney, Agent, or Firm*—Birch, Stewart, Kolasch & Birch, LLP

(57) ABSTRACT

A transfer head 9 of a coating film transfer tool 1 includes a tape supply surface 11 in which a transfer object surface side thereof is flat and a tape winding surface 12 in which a top end of an opposite side thereto is curved such that it is swollen outward. Both the surfaces intersect with each other so as to form a transfer edge 9 in a straight line. As a result, a beginning point of the coating film on the coating film transfer tape can be confirmed securely and the stiffness of the transfer head is improved thereby making it possible to cut the coating film sharply.

2 Claims, 2 Drawing Sheets

TRANSFER HEAD OF A COATING FILM TRANSFER TOOL

BACKGROUND OF THE INVENTION

1. Field of the Invention

This invention relates to a structure of a coating film transfer tool for use for coating with a fluorescent tape, tape adhesive or the like as well as coating with a correcting tape to correct a writing error caused by a writing tool such as a ball point pen or the like.

2. Description of the Prior Art

In a conventional transfer head for use in a coating film transfer tool using a corrective paint transfer tape, which is used for correcting a writing error caused by a writing tool such like a ball point pen or the like, a front end thereof is formed in the shape of a sharp edge (Examined Published Japanese Patent Application No. HEI3-11639) or a round edge (Examined Published Japanese Patent Application No.HEI6-33125). These structures are designed for the reason that, with the corrective paint transfer tape brought into intimate contact with a necessary place, the coating film transfer tool is slid to press the corrective paint transfer tape from its back side, so that the corrective paint on the surface of the corrective paint transfer tape is transferred and applied to the surface. If the transfer and application of the corrective paint on the surface of the corrective paint transfer tape is terminated at a necessary place, the corrective paint on the surface of the corrective paint transfer tape is cut by pressing it from its back side.

However, if the front end of the transfer head constituting the coating film transfer tool is in such a sharp edge as disclosed in Examined Published Japanese Patent Application No.HEI3-11639 according to the conventional art, when a procedure for transferring and coating the corrective paint on the corrective paint transfer tape is started, this work can be carried out accurately because a beginning point of a non-used portion of the corrective paint transfer tape can be confirmed easily. However, the front end of the transfer head is thin and has an elasticity, so that with an increased frequency of use, the front end of the transfer head is deformed. As a result, the corrective paint transfer tape comes into a contact with the transfer object surface through a surface contact. Therefore, when the corrective paint on the surface of the corrective paint transfer tape is cut off after the transfer and coating of the corrective paint to a desired position is terminated, a sufficient pressure is not transmitted concentratedly and equally to the corrective paint transfer tape. Consequently, the corrective paint on the surface of the corrective paint transfer tape cannot be cut in a straight line, so that a partial peeling or the like occurs thereby making it difficult to carry out transfer and coating of the corrective paint accurately. Further, because the corrective paint transfer tape after use is not guided by a back side of the transfer head, if the corrective paint transfer tape is wound rapidly, an unexpected vibration occurs, so that such an inconvenience as slippage from the transfer head and cutting of the tape occurs. Further, when this transfer head is molded by synthetic resin, production of dies for that transfer head is very difficult because the front end of the transfer head is in a sharp edge or thin, so that there is a fear that production cost may be raised.

In case the end of the transfer head is round as disclosed in Examined Published Japanese Patent Application No.HEI6-33125, when the corrective paint on the surface of the corrective paint transfer tape is cut by pressure after the transfer and coating of the corrective paint to a desired position is terminated, the corrective paint transfer tape comes into a contact with the transfer object surface through a surface contact, because the end of the transfer head is round. Consequently, a pressure necessary for cutting the corrective paint by pressure is not transmitted concentratedly and equally to the corrective paint transfer tape, so that the corrective paint on the surface of the corrective paint transfer tape cannot be cut in a straight line. As a result, a partial peeling or the like occurs thereby making it difficult to carry out accurate transfer and coating of the corrective paint. In case the corrective paint is transferred and applied from the corrective paint transfer tape, pressing on the corrective paint transfer tape by the transfer head is carried out through an entire transfer head, namely through a surface. Therefore, it is difficult to make the non-used portion of the corrective paint transfer tape accurately on a transfer starting point on the transfer object surface and then start pressing by the transfer head from that transfer starting point. Further, it is also difficult to accurately confirm the beginning point of the corrective paint transfer tape because of a partial peeling or the like caused on the surface of the corrective paint transfer tape. Therefore, sometimes, the corrective work cannot be carried out rapidly and accurately.

SUMMARY OF THE INVENTION

Accordingly, the present invention has been made to solve the above problems and therefore, an object of the invention is to provide a coating film transfer tool capable of transferring and applying a coating film on the surface of a coating film transfer tape accurately and easily by feeding and winding the coating film transfer tape smoothly.

To achieve the above object, the present invention provides a transfer head of a coating film transfer tool, the transfer head including a flat surface to oppose the transfer object surface and another surface having a curved top end, a linear transfer edge being formed by intersection between both the surfaces, an angle $\alpha$ between the transfer object surface side and the curved end surface on an opposite side thereto is less than 90°, the top end of a surface at the opposite side to the transfer object surface side being curved in a condition that the curvature 'R is in a range of 0.3–1.5 mm.

In the coating film transfer tool of the embodiment of the present invention, in case the transfer head constituting the coating film transfer tool is intended to be brought into firm contact with the transfer object surface through the coating film transfer tape, the transfer edge at the front end of the transfer head meets the beginning point of the coating film transfer tape. Thus, a user can always make sure of the beginning point of the non-used portion of the coating film transfer tape accurately. Therefore, the user can transfer and apply the coating film on the surface of the coating film transfer tape to the transfer object surface rapidly, accurately and easily. Further, the transfer head includes a flat surface to oppose the transfer object surface and another surface having the curved top end while the transfer edge is formed in a straight line by an intersection between both the surfaces. Particularly on the transfer edge at the front end of the aforementioned transfer head, the angle $\alpha$ between the transfer object surface side and the curved end surface on the opposite side thereto is less than 90°. The top end of the transfer head on an opposite side to the transfer object surface is curved so that the front end of the transfer head is thick thereby intensifying stiffness of the transfer head. Therefore, despite increased frequencies of this coating film transfer tool, the front end of the transfer head is difficult to deform. Even if a pressure is applied to cut off the coating film on the surface of the coating film transfer tape after transfer and coating of the coating film to a desired position is finished, that pressure is transmitted securely to the coating film transfer tape through the linear transfer edge, so that a partial peeling or the like never occurs. As a result, the coating film on the surface of the coating film transfer tape is cut sharply in a straight line.

Further, because the top end of the opposite side to the aforementioned transfer surface side is curved in the condition that the curvature R of the curved surface is 0.3–1.5 mm, the coating film transfer tape after use to be wound by the winding reel is guided by the front end of the transfer head such that it keeps a firm contact with the back of the tape. As a result, even if the tape is wound by the winding reel rapidly, the tape is prevented from vibrating vertically and horizontally with a restriction of the guiding plate for also preventing the coating film transfer tape from vibrating vertically and horizontally with respect to the winding direction of the coating film transfer tape. As a result, it is possible to prevent a slippage, cutting and the like on the transfer tape. Further because the transfer head is thick, production of dies for use in molding is facilitated thereby making it possible to reduce production cost.

DESCRIPTION OF THE PREFERRED EMBODIMENTS

Figure 1:
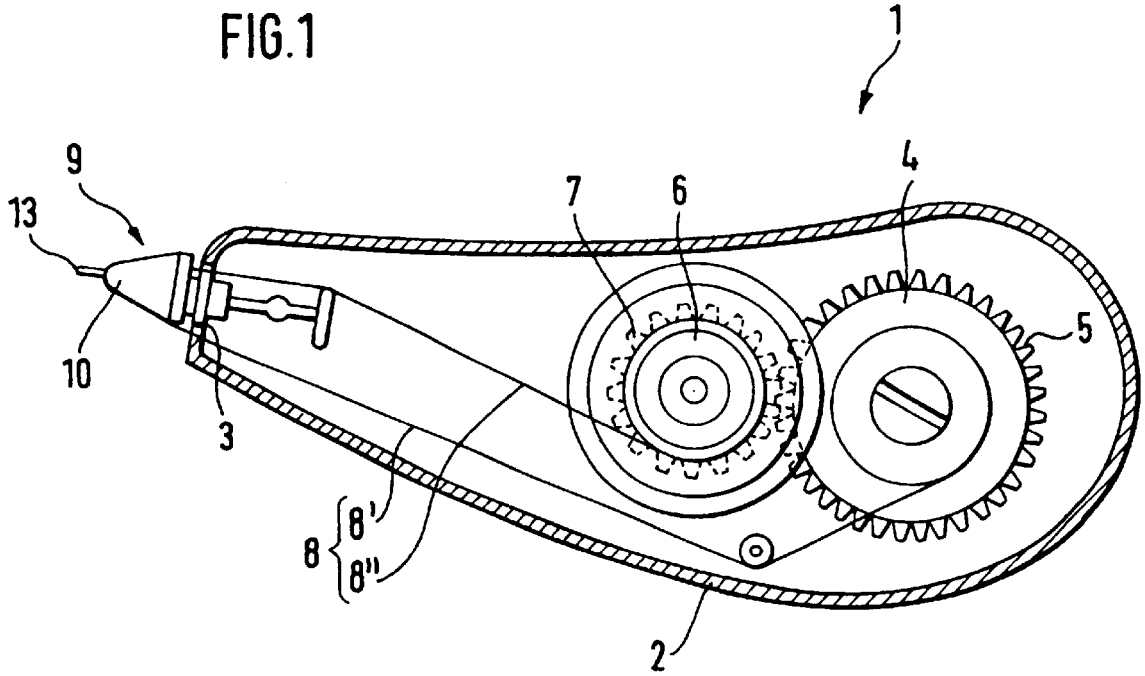
FIG. 1 is a front view of a coating film transfer tool according to an embodiment of the present invention.
Figure 2:
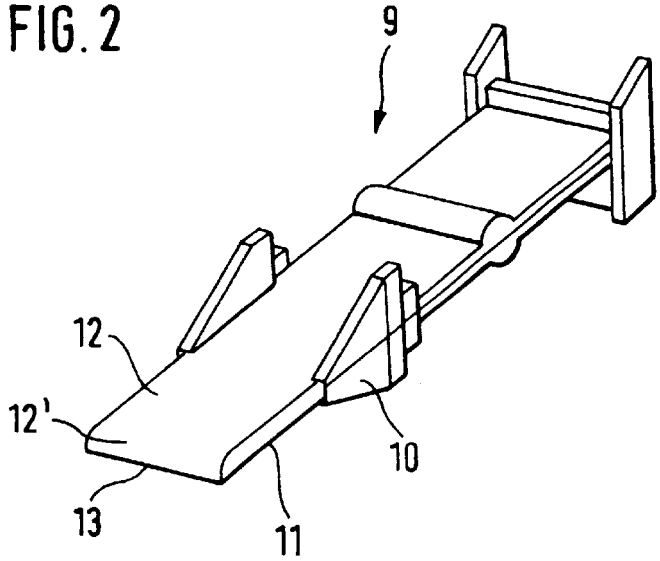
FIG. 2 is an enlarged perspective view of a transfer head of the coating film transfer tool of the embodiment of the present invention.
Figure 3:
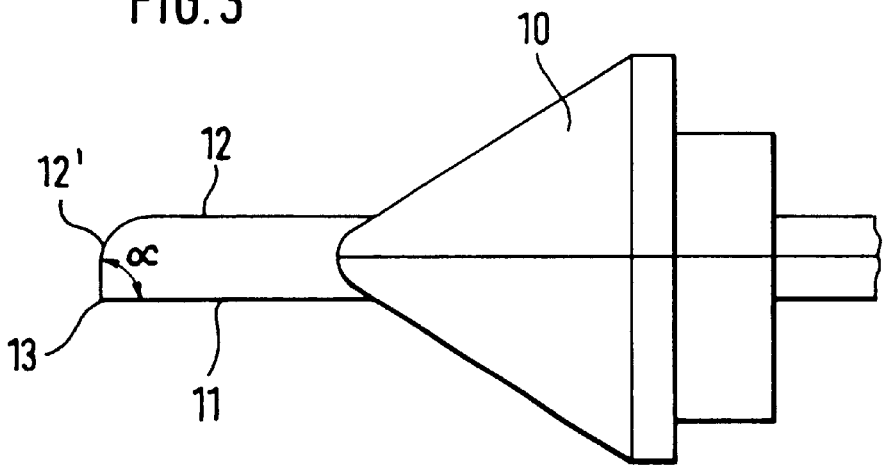
FIG. 3 is an enlarged side view of a front end portion of the transfer head of the coating film transfer tool of the embodiment of the present invention.
Figure 4:
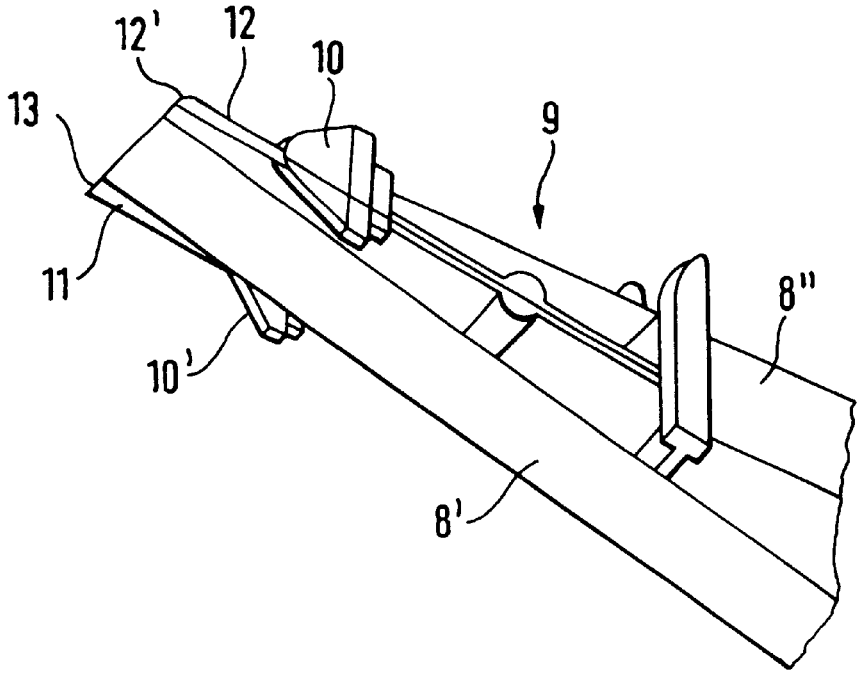
FIG. 4 is an enlarged perspective view of the transfer head as viewed from below when the coating film transfer tool of the embodiment of the present invention is on use.

This invention will be described with reference to the embodiments shown in drawings. Referring to FIG. 1, reference numeral 1 denotes a coating film transfer tool according to an embodiment of the present invention. This coating film transfer tool 1 comprises a coating film transfer tool main unit 2, a supply reel 4 which is rotatably journaled within this coating film transfer tool main unit 2 for feeding the tape to a transfer head 9 held so as to project from a front end opening portion 3 of the coating film transfer tool main unit 2, the transfer head being provided with guide plates 10 for guiding the coating film transfer tape 8 such that the coating film transfer tape 8' before use, such as corrective paint transfer tape, fluorescent tape and the like is wound therearound and coming into a firm contact with a transfer object surface so as to transfer and coat the coating film on the surface of the coating film transfer tape 8 such as corrective paint transfer tape, fluorescent tape, adhesive tape and the like, and a winding reel 6 which is journaled on the same shaft as a winding reel gear 7 meshing with a supply reel gear 5 journaled on the same shaft as the supply reel 4 and is rotated interlocking through the supply reel 4 and gear engagement between the supply reel gear 5 and winding reel gear 7 so as to wind the coating film transfer tape 8" such as corrective paint transfer tape, fluorescent tape, adhesive tape and the like via the transfer head 9.

The transfer head 9 held so as to project from the front end opening portion 3 of the coating film transfer tool main unit 2 constituting the aforementioned coating film transfer tool 1 and coming into a firm contact with the transfer object surface for transferring and coating the coating film on the surface of the coating film transfer tape 8, comprises a tape supply surface 11 having the guide plates 10 provided on the right and left thereof for guiding the coating film transfer tape 8, in which a transfer object surface side thereof is flat, and a tape winding surface 12 in which a top end on an opposite side to the tape supply surface 11 is curved so as to be swollen outward. The tape supply surface 11 on the transfer object surface side and the tape winding surface 12 having an curved top end 12' on the opposite side intersect with each other so as to form a linear transfer edge 13. Particularly on the transfer edge 13 at the front end of the transfer head 9, an angle $\alpha$ between the tape supply surface 11 on the transfer object surface side and the curved top end 12' of the tape winding surface 12 on the opposite side is less than 90°. A curvature R of that curved top end 12' of the tape winding surface 12 is 0.3–1.5 mm.

The coating film transfer tool 1 of this embodiment has the above described structure. Upon use of this coating film transfer tool 1, if the transfer head 9 projecting from the front end opening portion 3 of the coating film transfer tool main unit 2 of the coating film transfer tool 1 is placed in firm contact with the transfer object surface, the transfer edge 13 at the front end of the transfer head 9 meets a beginning point of the coating film transfer tape 8' before use. Thus, it is always possible to confirm the beginning point of a non-used portion of the coating film transfer tape 8 accurately. Therefore, the coating film on the surface of the coating film transfer tape 8 can be transferred and applied to the transfer object surface rapidly, accurately and easily.

Further, the transfer edge 13 at the front end of the transfer head 9 of the coating film transfer tool 1 is formed in a straight line by making the tape supply surface 11 in which the transfer object surface side thereof is flat and the tape winding surface 12 in which the top end thereof on the opposite side is curved intersect with each other. Particularly at the transfer edge 13 at the front end of the transfer head 9, the angle $\alpha$ between the tape supply surface 11 and the curved top end 12' of the tape winding surface 12 is less than 90°. The top end of the transfer head 13 on the side of the tape winding surface 12 is curved so that the front end of the transfer head 9 is thick thereby intensifying stiffness of the transfer head 9. Therefore, despite increased frequencies of this coating film transfer tool 1, the front end of the transfer head 9 is difficult to deform. Even if a pressure is applied to cut off the coating film on the surface of the coating film transfer tape 8 after transfer and coating of the coating film to a desired position is finished, that pressure is transmitted securely to the coating film transfer tape 8 through the linear transfer edge 13, so that a partial peeling or the like never occurs. As a result, the coating film on the surface of the coating film transfer tape 8 is cut sharply in a straight line, thereby making it possible to finish the transfer and coating of the coating film beautifully.

Further, because the top end of the tape winding surface 12 on the opposite side to the tape supply surface 11 is curved in the condition that the curvature R of the curved top end 12' is 0.3–1.5 mm, the coating film transfer tape 8" after use to be wound by the winding reel 6 is guided by the front end of the transfer head 9 such that it keeps a firm contact with the tape. As a result, even if the tape is wound by the winding reel 6 rapidly, the tape 8 is prevented from vibrating vertically and horizontally with a restriction of the guiding plate 10 provided on both sides of the transfer head 9. As a result, it is possible to prevent a slippage of the coating film transfer tape 8 from the transfer head 9, cutting thereof and the like. Further, because the transfer head 9 is thick, production of dies for use in molding is facilitated thereby production cost being reduced.

Because this invention has the above described structure, the beginning point of the coating film on the surface of the coating film transfer tape can be confirmed securely by the transfer edge. Because the stiffness of the transfer head is improved to prevent deformation, the transfer and coating of the coating film can be carried out rapidly, accurately and easily. Because the top end of the transfer head on the tape winding surface side is curved such that it is swollen outward, the front end of the transfer head is thick thereby improving stiffness of the transfer edge. As a result, cutting of the tape along the transfer edge can be carried out sharply in a straight line, thereby making it possible to finish the transfer and coating of the coating film beautifully. Further, because the coating film transfer tape after use is guided and supported from the back, even if vibration occurs due to a rapid winding or the like, the slippage of the tape from the transfer head, cutting of the tape and the like can be prevented.

What is claimed is:

1. A transfer head of a coating film transfer device, comprising:

an upstream tape supply surface; and a downstream tape winding surface having a curved surface portion, said curved surface portion having a curvature in a range of 0.3–1.5 mm and having a distal end thereof adjoining said upstream tape supply surface to form a linear transfer edge, wherein surfaces defining the linear transfer edge define an angle less than 90° therebetween and said upstream tape supply and downstream tape winding surfaces receive a coating film transfer tape from the coating film transfer device, whereby the coating film transfer tape passes first over the linear transfer edge and then over the curved surface portion.

2. The transfer head according to claim 1, further comprising guide plates integrally formed on lateral portions of the transfer head.

* * * * *